US005467724A

United States Patent [19]

Bardsley et al.

[11] Patent Number: 5,467,724

[45] Date of Patent: Nov. 21, 1995

[54] YARN JERKER AND THREADER GUIDE FOR TUFTING MACHINES

[75] Inventors: Harold B. Bardsley, Nr. Chorley; Arthur Bagnall, Whitefield, both of England

[73] Assignee: Spencer Wright Industries, Inc., Dalton, Ga.

[21] Appl. No.: 180,630

[22] Filed: Jan. 13, 1994

[30] Foreign Application Priority Data

Feb. 11, 1993 [GB] United Kingdom ..... 9302718

[51] Int. Cl.[6] ..... D05C 15/16

[52] U.S. Cl. ..... 112/80.7

[58] Field of Search ..... 112/80.7, 80.45, 112/302, 245, 226, 80.71

[56] References Cited

U.S. PATENT DOCUMENTS

| | | | |
|---|---|---|---|
| 3,160,125 | 12/1964 | Bryant et al. | 112/80.7 X |
| 3,203,379 | 8/1965 | Dedmon et al. | 112/80.7 X |
| 3,861,429 | 1/1975 | Broadrick et al. | 112/80.7 X |
| 4,048,930 | 9/1977 | Card | 112/80.7 X |
| 4,062,308 | 12/1977 | Spanel et al. | 112/80.7 |
| 4,138,956 | 2/1979 | Parsons | 112/226 |

FOREIGN PATENT DOCUMENTS

| | | | |
|---|---|---|---|
| 712381 | 6/1965 | Canada | 112/80.71 |
| 63-275772 | 11/1988 | Japan | 112/80.71 |
| 1163510 | 9/1967 | United Kingdom | 112/302 |

*Primary Examiner*—Paul C. Lewis
*Attorney, Agent, or Firm*—Alan Ruderman

[57] ABSTRACT

A tufting machine including a reciprocating needle bar carrying needles has a yarn jerker including a stationary adjustable yarn guide and a combination yarn jerker and threader carried by the needle bar. The jerker-threader has a substantially U-shape configuration with little mass offset from the needle bar. At least one arm of the jerker-threader is substantially parallel to the axis of elongation of the needles. The stationary guide has a leg which is also substantially parallel to the axis of elongation of the needle. The stationary yarn guide, the jerker-threader and the needles each have eyelets parallel to one another. The jerker-threader and the yarn guide are spaced apart by a relatively small distance and are offset one from the other. The construction permits the apparatus to occupy only a small amount of space in the tufting machine and has very little mass offset from the needle bar in comparison to prior yarn jerker systems.

8 Claims, 2 Drawing Sheets

YARN JERKER AND THREADER GUIDE FOR TUFTING MACHINES

BACKGROUND OF THE INVENTION

This invention relates to tufting machines and more particularly to yarn handling apparatus including a yarn jerker for tufting machines.

In the production of tufted fabrics such as carpets and the like by the repeated penetration of a multiplicity of yarn carrying needles through a backing material, the needles cooperate with respective loopers or hooks to form loops in the backing material as it advances between successive needle insertions. Yarn is supplied to the needle by yarn feed mechanism at a rate which is substantially constant and which is sufficient to provide the overall yarn requirements of the needle for forming the successive loops in the backing material being tufted.

A yarn guide system is also conventionally used and this system usually comprises at least one fixed yarn guide, an adjustable stationary jerker guide, a movable jerker guide and a threader bar which takes yarn from the yarn feed mechanism and feeds it to the respective needle. Since the take-up of yarn is not constant as the needle forms a loop which is seized by the hook or looper and continues to move upwardly in readiness to begin formation of the next loop, the jerker guides function to tension the yarn and moderate variations in take-up of yarn at the needle. Conventionally, the stationary and moving jerker guides are mounted on the tufting machine frame and the needle bar respectively and are spaced apart by a relatively large distance from the needles. Additionally, the movable jerker includes an elongated upwardly inclined arm extending away from the needle bar. Thus, the jerkers occupy a significant amount of space in the tufting machine. Furthermore, and more significantly, since the moving jerker bar is attached to the needle bar, the needle bar carries a considerable offset mass, and this has a detrimental effect on the dynamic characteristics of the tufting machine.

SUMMARY OF THE INVENTION

Consequently, it is a primary object of the present invention to provide yarn jerker and guide apparatus for a tufting machine which is of reduced size and mass relative to conventional yarn feed and guide apparatus and which has at least comparable efficiency.

It is another object of the present invention to provide a yarn jerker and guide apparatus which eliminates the need for a separate yarn jerker and thread guide to be moving with the needle bar.

It is a further object of the present invention to provide a yarn feeding guide apparatus having a substantially U-shaped guide carried by the needle bar of a tufting machine which in combination with a fixed yarn guide functions as a moving jerker and as a threader bar, thereby reducing the mass and offset mass carried by the needle bar.

Accordingly, the present invention provides yarn handling apparatus for a tufting machine for feeding yarn to one or more needles, the apparatus comprising a stationary adjustable yarn guide and a combination yarn jerker and threader carried by the needle bar of the machine. The jerker-threader and the guide are spaced apart by a relatively small distance so that yarn passes directly from the guide to the jerker-threader. The jerker-threader has a substantially U-shape configuration with little mass offset from the needle bar, and since the jerker-threader and the stationary guide are closely spaced, the apparatus occupies only a small amount of space in the tufting machine. The invention permits the yarn handling apparatus to be of reduced size and mass compared to conventional yarn handling apparatus and may be of improved efficiency.

The movable jerker-threader and the stationary guide have respective arrays of holes therein through which the yarn passes. The holes in the jerker-threader and the guide are substantially identical such that a jerker function may be performed without the need for any additional yarn jerkers.

Preferably, the jerker-threader comprises a generally U-shaped member having apertures through which the yarn may pass in one leg thereof. Another leg of the jerker-threader may be secured to the needle bar of the tufting machine or alternatively may be secured to a needle module which is secured to the needle bar of the tufting machine. When mounted in the tufting machine the axis of the leg through which the yarn passes is generally parallel to the longitudinal axis of the needles carried by the needle bar.

It has been found that a threader-jerker of the present invention results in an increase in the rigidity and strength of the moving combination needle bar, needle module and threader in a direction generally transverse to the axis of the needle. Furthermore, the close proximity of the jerker-threader and the stationary yarn guide and the omission of a separate jerker significantly decreases the space occupied by the yarn handling system and also the mass thereof.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
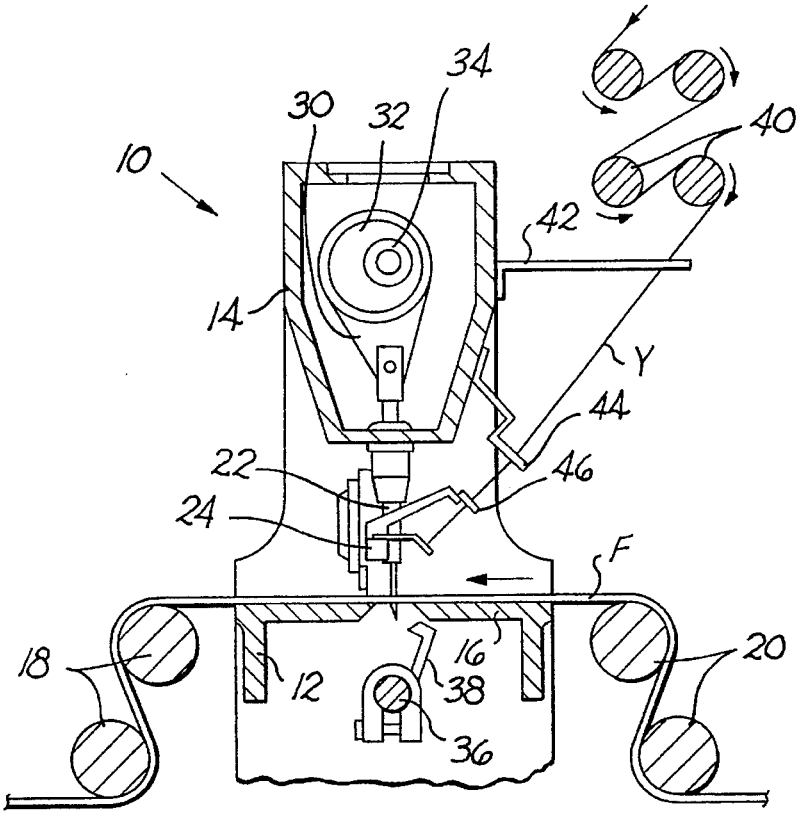
PRIOR ART FIG. 1
FIG. 1 is a diagrammatic transverse cross sectional view through a multi-needle tufting machine incorporating yarn jerker and threader apparatus constructed in accordance with the prior art.
Figure 3:
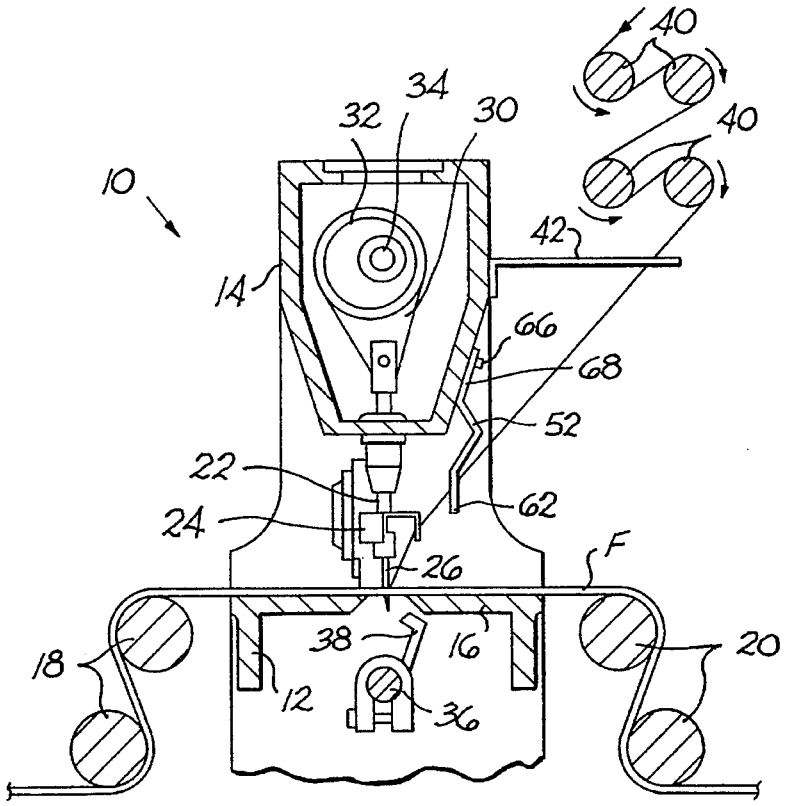
FIG. 3 is a view similar to FIG. 1 but illustrating yarn jerker and guiding apparatus constructed in accordance with one embodiment of the present invention.

Referring to the drawings, FIGS. 1 and 3 illustrate a tufting machine 10 conventionally having a frame comprising a bed 12 and a head 14 disposed above the bed. The bed 12 includes a base plate 16 across which fabric F is adapted to be fed by a pair of feed rollers 18 and take-off rolls 20.

Mounted in the head 14 for vertical reciprocation is one of a plurality of push rods 22 to the lower end of which a needle bar 24 is carried. The needle bar 24 carries a plurality of needles 26 preferably mounted in modular form within a body member 28. The body member 28 being secured to the lower end of the needle bar. The needles have respective eyes 27 and are adapted to penetrate the fabric F on the bed plate 16 upon reciprocation of the needle bar 24 to project loops of yarn therethrough. End-wise reciprocation is imparted to the push rods 22 and thus the needle bar 24 and needles 26 by, for example, a link 30 which is pivotably connected at its lower end to the push rods 22 and at its upper end to an eccentric 32 on a driven rotary main shaft 34 journally mounted laterally in the head 14 as is notoriously well known in the art.

Journalled beneath the bed plate 16 is an oscillating hook or looper shaft 36 which is arranged parallel to the main shaft 34 and which carries a plurality of hooks or loopers 38. Each hook or looper 38 cooperates with a respective needle 26. While, to simplify the disclosure, only a single needle 26 and a single hook or looper 38 is shown, it is understood that a multiplicity of such elements are provided laterally across the machine.

Figure 2:
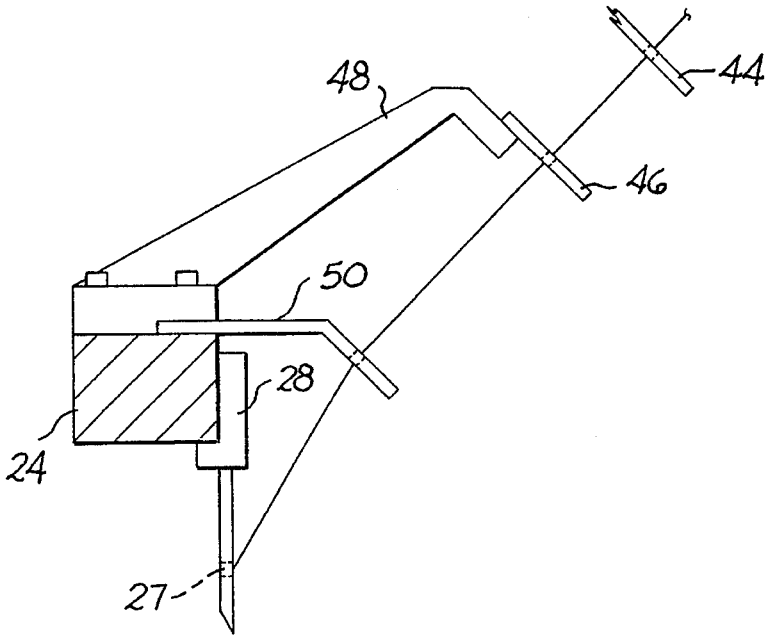
PRIOR ART FIG. 2
FIG. 2 is an enlarged portion of the yarn jerker and threader structure of FIG. 1.

Yarn Y may be fed to the needles 26 at a constant rate by means of a plurality of yarn feed rollers 40 which may be mounted on or above the head 14 of the tufting machine 10. Yarn is received from a creel (not illustrated) and is wrapped or trained about the rollers 40 for feeding yarn through one or more stationary guides 42 secured to the head 14 of the tufting machine. In the prior art, as illustrated in FIGS. 1 and 2, the yarn guide and jerker system includes a fixed jerker guide 44 secured to the head 14, a moving jerker bar 46 carried by an elongated arm 48 secured to the needle bar 24 in an offset fashion, and a threader plate 50 secured to the needle bar 24 adjacent to the connection of the arm 48. Yarn passes through the jerker guides 44 and 46 to the threader plate 50 and onto the eye 27 of the needle 26, the fixed jerker guide 44 being adjustable vertically on the head of the tufting machine so as to vary the jerk effect produced between the fixed jerker guide 44 and the moving jerker 46 as the needle bar reciprocates. It will be appreciated that this mechanism occupies a relatively large amount of space in a tufting machine due to the spacing of the components. For example, the extended arm 48 of the moving jerker 46 and its angular relationship requires that the fixed jerker 44 be disposed substantially outstanding from the head of the tufting machine. The disposition of the holes in the fixed jerker and the movable jerker and that of the threader plate 50 as a result of the requirements of the movable jerker mandate this inefficient use of space in the tufting machine. Additionally, because of the number of components carried by the needle bar, there is considerable mass carried by the needle bar in offset fashion in addition to the mass of the needles.

Figure 4:
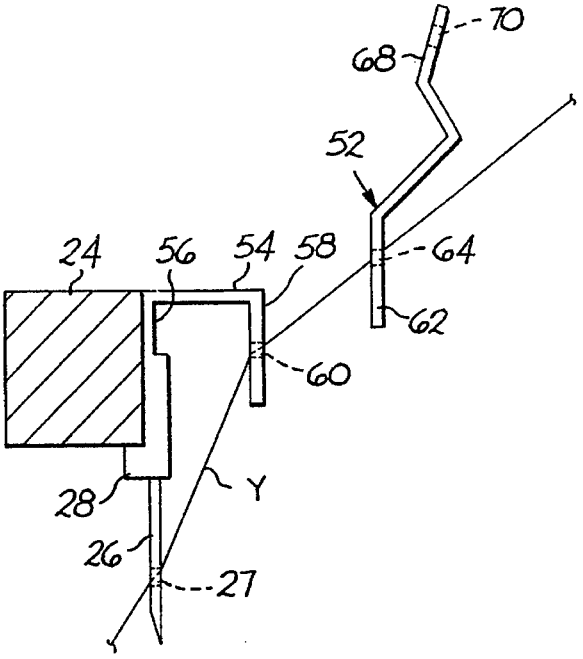
FIG. 4 is an enlarged view of the yarn jerker and guiding apparatus illustrated in FIG. 3.
Figure 5:
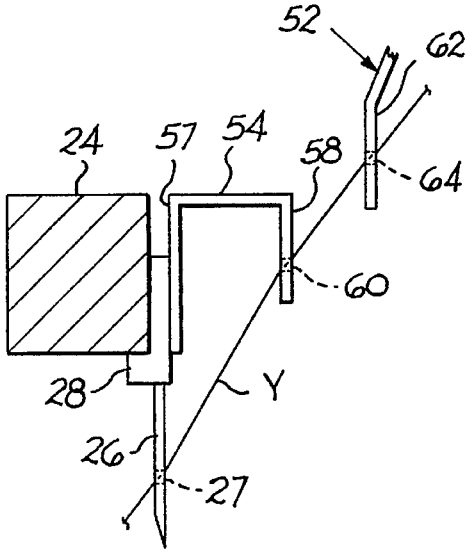
FIG. 5 is a view similar to FIG. 4 of an alternative mounting of a yarn jerker and guiding apparatus constructed in accordance with the present invention.

In reference to FIGS. 3 and 4, the yarn handling apparatus of the present invention comprises a fixed, but vertically adjustable jerker 52 mounted on the head of the tufting machine in relatively close proximity to the needle bar 24 and to a generally U-shaped threader-jerker member 54 carried by the needle bar 24. The jerker-threader member 54 includes a pair of spaced apart substantially parallel arms 56, 58, the arm 56 being a mounting element which may be secured directly to the needle bar as illustrated in FIG. 4. The mounting arm, however, may be secured to the body member 28 of the needle module as illustrated in FIG. 5 where that arm is designated 57. In FIG. 4, where the arm 56 is secured directly to the needle bar, the arm 56 may be shorter than the arm 58, while in the case where the mounting arm 57 is secured to the needle module, it may be longer than the arm 58.

The arm 58, which is the arm remote from the needle bar 24, includes an array of apertures 60, each aperture 60 corresponding to the eye 27 of each needle 26 served by the jerker-threader. The arm 58 is substantially parallel to the axis of the needles 26 and is additionally parallel to and offset from a face 62 of the fixed jerker 52, the face 62 having an aperture 64 corresponding to each aperture 60. The relative disposition laterally of the apertures 60 and 64 are substantially identical, but the apertures are offset vertically. Additionally, it may be noted that the needle eyes 27 and the apertures 60 and 64 are substantially parallel to one another. A jerker-threader having this construction and disposition is such that there is no need to provide separate movable jerker bars and threader plates since the arm 58 of the jerker-threader 54 is disposed in relative close proximity to both the eye of the needle 26 and the apertures 64 of the fixed jerker 52 while providing the proper jerking action to the arm. Thus, a reduction in the mass of the yarn handling apparatus carried by the needle bar 24, and especially the offset mass, is substantially reduced relative to the prior art, and additionally there is a reduction in the space occupied by the yarn handling apparatus. Should variations in the jerking action be necessary to achieve desired control of yarn tension to enable proper tufting, the fixed jerker 52 may be adjusted vertically relative to the tufting machine head by conventional means such as bolts 66 disposed in elongated holes 70 in the mounting arm 68 of the fixed jerker.

In use, yarn Y is fed from the yarn feed rollers 40, through the holes or array of holes in the yarn guides 42, through the holes or array of holes 64 in the fixed jerker 52, through the hole or array of holes 60 in the jerker-threader 54 and into the eye 27 of each respective needle 26. The tufting process is carried out in a conventional manner by repeated reciprocation of the needles through the advancing backing material F and into cooperation with the respective loopers or hooks 38 to form the pile of the tufted fabric.

It will be appreciated that with the decrease in the number of components in the yarn handling apparatus, the moving mass of the tufting machine is reduced, as is the space occupied by the yarn handling apparatus of the present invention, thereby providing greater benefits without sacrificing efficiency. A further advantage which has arisen out of the present invention is that by having a jerker-threader 54 of the configuration of the present invention and by mounting it to the needle bar or the needle module in the manner heretofore described, a relatively large increase in the rigidity and security of these moving elements may be achieved. This is significant since any relevant movement of these parts and flexibility therein can introduce errors in the formation of loops in the backing material which would detract from the finished appearance of the fabric produced.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a needle bar, a needle having an axis of elongation carried by said needle bar, said needle including an eye through which a strand of yarn may be threaded, means for reciprocating said needle bar toward and away from a backing material for penetrating said needles into and out of said backing, yarn feed means for feeding a strand of yarn to said needle, and yarn handling apparatus intermediate said feed means and said needle for tensioning and guiding yarn to said needle, said yarn handling apparatus comprising a stationary guide member having a face substantially parallel to said axis of elongation, an aperture extending through said face for receiving a strand of yarn from said feed means, a movable guide member carried by said needle bar, said movable guide member having an arm spaced from said needle bar and parallel to said axis of elongation, and an eyelet extending through said arm disposed at an elevation not above said needle bar spaced from and offset from said aperture for receiving a strand of yarn fed from said aperture toward said needle eye and for jerking and tensioning said strand of yarn as said needle bar reciprocates away from said backing.

2. In a tufting machine as recited in claim 1, wherein said needle eye, said aperture and said eyelet are substantially parallel.

3. In a tufting machine as recited in claim 1, wherein said movable guide member has a substantially U-shape configuration, said arm being a first arm of said movable guide member, said movable guide member having a second arm spaced from said first arm and substantially parallel thereto, and means for securing said second arm to said needle bar.

4. In a tufting machine as recited in claim 3, wherein said needle eye, said aperture and said eyelet are substantially parallel.

5. In a tufting machine as recited in claim 3, wherein said needle is one of a plurality of needles mounted within a modular needle body member secured to said needle bar, and said second arm is secured to said body member.

6. In a tufting machine as recited in claim 5, wherein said needle eye, said aperture and said eyelet are substantially parallel.

7. In a tufting machine having a needle bar, a needle having an axis of elongation carried by said needle bar, said needle including an eye through which a strand of yarn may be threaded, means for reciprocating said needle bar vertically toward and away from a backing material for penetrating said needles into and out of said backing, yarn feed means for feeding a strand of yarn to said needle, and yarn handling apparatus intermediate said feed means and said needle for tensioning and guiding yarn to said needle, said yarn handling apparatus comprising a stationary guide member including a surface having an aperture extending therethrough for receiving a strand of yarn from said feed means, a single movable guide and jerker member carried by said needle bar, said movable guide member having an arm spaced from said needle bar including an eyelet extending through said arm, said eyelet being disposed at an elevation not above said needle bar, said arm being disposed in a vertical plane intermediate said surface and said needle and said eyelet being spaced horizontally in close proximity to said eye and said aperture for receiving a strand of yarn fed through said aperture directly to said eyelet toward said needle eye and for jerking and tensioning said strand of yarn as said needle bar reciprocates away from said backing, there being no other yarn guide between said eyelet and said needle eye.

8. In a tufting machine as recited in claim 7, wherein said needle is one of a plurality of needles mounted within a modular needle body member secured to said needle bar, and means for securing said arm to said body member.

* * * * *